United States Patent [19]

Belli et al.

[11] 3,972,086

[45] Aug. 3, 1976

[54] MACHINE FOR ASSEMBLING SHOE UPPERS DIRECTLY ON ASSEMBLY FORMS

[76] Inventors: Luciano Belli, P.za Trento Trieste, 1, Busto Arisizio, Varese; Ezio Toja, Via Bellingera, 2, Legnano, Milan, both of Italy

[22] Filed: Feb. 24, 1975

[21] Appl. No.: 552,002

[30] Foreign Application Priority Data

June 21, 1974 Italy.....24286/74

[52] U.S. Cl...... 12/7.9; 12/145

[51] Int. Cl.[2] ..... A43D 15/00; A43D 21/00

[58] Field of Search ..... 12/7.9, 8.1, 7, 145

[56] References Cited

UNITED STATES PATENTS

| | | | |
|---|---|---|---|
| 2,226,758 | 12/1940 | Fausse | 12/7.9 |
| 2,344,503 | 3/1944 | Cuozzo | 12/7.9 |
| 3,432,869 | 3/1969 | Jurik et al. | 12/145 |
| 3,678,522 | 7/1972 | Bumbatch et al. | 12/145 |

*Primary Examiner*—Patrick D. Lawson
*Attorney, Agent, or Firm*—Guido Modiano; Albert Josif

[57] ABSTRACT

A machine for assembling uppers directly on assembly forms which comprises means for removably blocking at least a form against rotation and translation, means for holding an upper predisposed for string lasting assemblage and an insole which is externally covered with glue on the form, grasping members for removably engaging the string projecting from the upper whose movement may be controlled so as to pull the string in order to have the tip and the heel of the upper adhere to the glue of the insole placed on the form, and finally elements for pressing the uppers so as to cause them to adhere to the insole.

2 Claims, 4 Drawing Figures

MACHINE FOR ASSEMBLING SHOE UPPERS DIRECTLY ON ASSEMBLY FORMS

BACKGROUND OF THE INVENTION

The present invention relates to a machine for automatically assembling uppers of shoes, slippers, boots and the like directly on assembly forms or lasts.

As is known, presently an upper is formed or shaped so as to say, according to substantially two main procedures, before applying the sole.

According to a first method traditionally used, the leather or whatever material the upper consists of, is formed and modelled in appropriate assembly machines of known type and well known to experts skilled in the art. In this traditional assembly, a series of successive operations are carried out according to each of which only one part of the upper is formed. Once the upper has been completely assembled, it is removed and attached, e.g. by means of gluing, to a sole, or inserted in a mould for direct moulding with the sole, e.g. by means of injection or vulcanizing machines.

According to another method, commonly known as American string assembly, also known as Ficelle, or string lasting, the material constituting the upper, already cut and sewed but not yet assembled, is fitted on the metallic form of a mould and with the aid of a string slidingly withheld along the margins of the upper, it is bent along its edges so as to obtain the desired form of the upper. In more detail, with this method, a string, held in place by an appropriate stitch and arranged so as to cross over itself in the front section of the upper, is inserted in loops provided along the edges of the upper which has not yet been formed. The ends of the string are made to project close to the shank so that if it is pulled, it tightens the leather or whatever and causes it to adhere to the metallic form of the mould.

Since the string intersects in a certain section, it blocks itself and it is therefore possible to cut the projecting strings without releasing it.

With this method however, the shanks which have to adhere onto the portion of the mould with the narrowest section, remain raised and it is necessary to fix them in adhering position by manually hooking them onto suitable pegs projecting from the narrowest section of the mould.

It has just recently been realized what great advantages, in terms of production rate and reduction of costs, can be obtained by direct formation of an upper on an assembly form, even directly insertable into a mould having the function of male element, for attachment to the sole. For this purpose, string assembly, Ficelle or string lasting is particularly useful, but a serious inconvenience has to be overcome: it is not possible to make a form of common type with fixed pegs or the like for hooking the shank portions of the uppers, without substantially modifying its structure and function. An attempt to solve the problem has been made, by means of an artifice which consists in fixing onto the insole, engaged on the assembly form, an insert made of steel or resin having these pegs or like members projecting towards the sole on which to hook the shanks. The insert will remain embedded in the sole during its formation. In this manner however, the use of an additional element is indispensable. The actual insert, appropriately made and shaped, is expensive and requires for its application an additional operation which slows down the production cycle of the shoe.

Furthermore it should be mentioned that all the fitting operations of the uppers to the form are substantially manual in that they depend on the action and capability of skilled labour and therefore particularly costly, even when the use of instruments such as for pulling of the strings, are reverted to for facilitating the work.

SUMMARY OF THE INVENTION

A main object of the invention is to obtain a machine capable of shaping and assembling shoe uppers directly onto shoe assembling forms, without requiring the aid of supplementary means of any type for fixing the shanks of the uppers on the form, and also capable of carrying out automatically all the various manufacturing steps for reducing manual operations to simple machine controls.

Another important object of the invention is to obtain a machine conceived in such a way as to produce a precise and accurate adherance of the upper to its form, thus completely avoiding the formation of creases or curling and mechanically simulating the operations carried out manually by the skilled person.

A further object is to obtain a machine which produces uppers at a fast rate and at a low cost, even without the aid of skilled personnel.

Still a further object is to provide a sturdy, simple and easily built machine and of the greatest reliability.

These and other objects, which will be more evident hereinafter, are attained by the machine according to the invention, characterised in that it comprises: means for removably blocking at least a form against translation and rotation, means for holding an upper and an insole, externally covered with glue, on said form, said upper being predisposed for "Ficelle" string assembly, grasping members for removably engaging the string projecting from said upper and controllably movable in a direction appropriate for pulling said string in order to have the tip and the heel of said upper adhere to the glue of said insole placed on the form, and elements for pressing the shanks of the upper so as to cause them to adhere to said insole.

Advantageously in the machine according to the invention these elements for pressing the shanks of the upper consist of clamps which bear on the shanks by means of elastic elements provided not only with the freedom to approach the upper, but also with the freedom to slide so as to stretch the upper and prevent the formation of creases.

BRIEF DESCRIPTION OF THE DRAWINGS

Further characteristics and advantages of the invention will be more evident from the description of a preferred but not exclusive embodiment of the machine, illustrated by way of a non-limiting example in the accompanying drawings in which.

DESCRIPTION OF A PREFERRED EMBODIMENT

Figure 1:
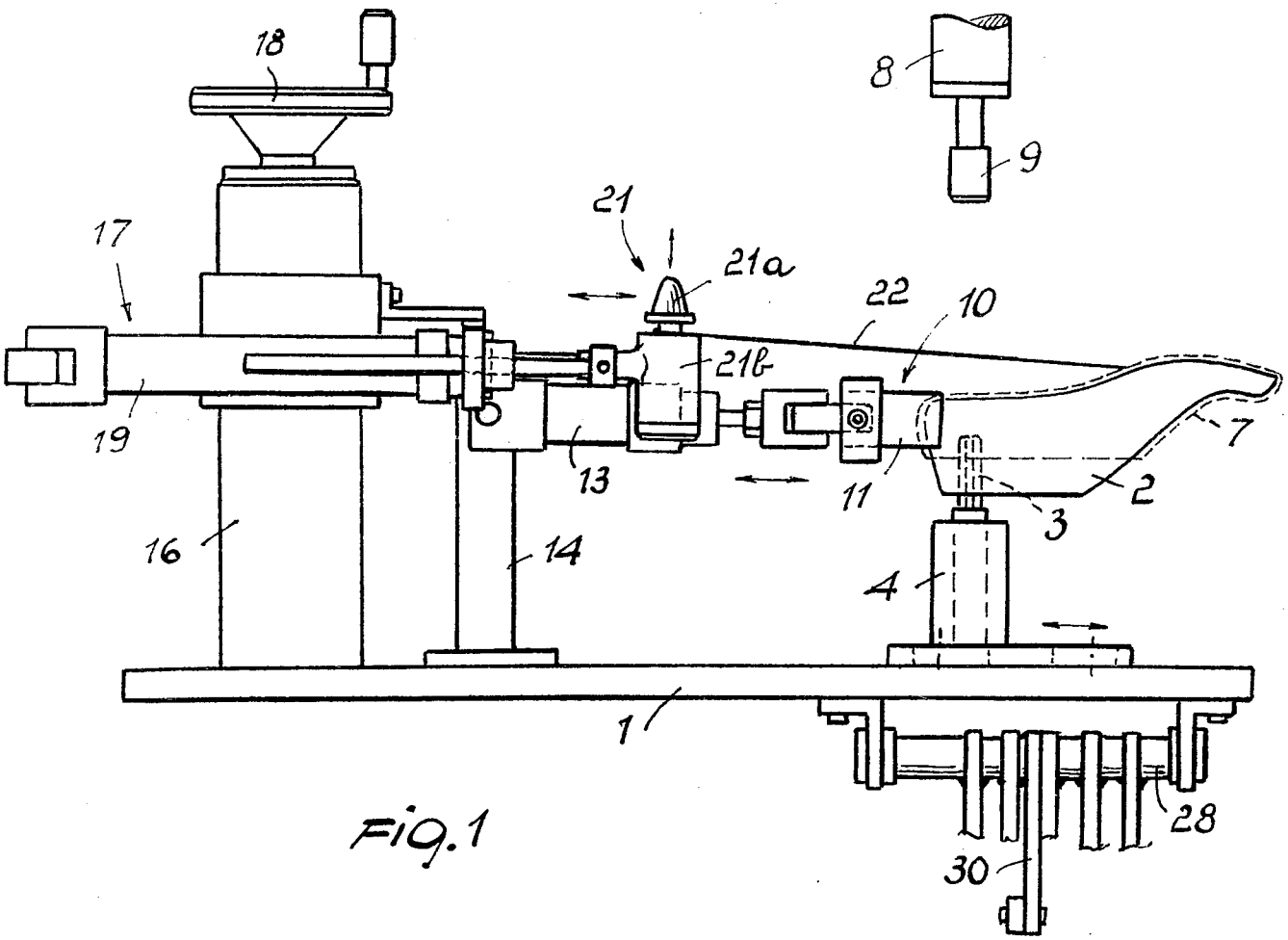
FIG. 1 is a side view of a portion of the machine according to the invention.

With reference to the above figures, the machine according to the invention consists of a support frame 1 to which a form 2 is removably engaged so as to be prevented from rotating and translating.

This engagement is obtained by means for locking the actual form 2 and consists of a vertical grooved rod 3, which can be inserted into the form 2 and held in place by a first support 4 whose position on the support frame 1 is adjustable by means of slots 5 within which are inserted bolts 6. The form 2 is placed in an inverted position, that is with sole facing upwards, so as to easily receive an upper 7. To assure that the form 2 is removably held in place, a first pneumatic cylinder 8, from which projects an appendix 9 which moves vertically and coaxially to the first cylinder 8 and engages coaxially to the rod 3 on that portion of form 2 which corresponds to the heel. Means for holding the upper 7 onto the form 2, when the upper 7 does not yet adhere to the form, is also provided. This means consists of adjustable locking members 10, which, in this particular embodiment, comprise an adjustable buffer 11, the front of which is provided with elastic material and the rear, opposite to the form 2, being articulated on a rod 12 projecting from a second pneumatic type cylinder. The second cylinder 13 is supported by a second support 14 engaged in turn to the frame 1. The second cylinder 13 is engaged to the second support 14 and can oscillate in a vertical plane. It is to be observed that the buffer 11 adheres with its front portion in elastic material to the form 2 or, more precisely, to the uppers 7 on the form 2 so as to prevent it from moving. An insole 15 covered with glue on the side facing away from the form 2, in correspondance to those sections where it will be bent and made to adhere to the uppers 7, is placed together with the upper 7 on the form 2. This insole 14, moreover, is held in place by the appendix 9 moved by the first cylinder 8.

Figure 2:
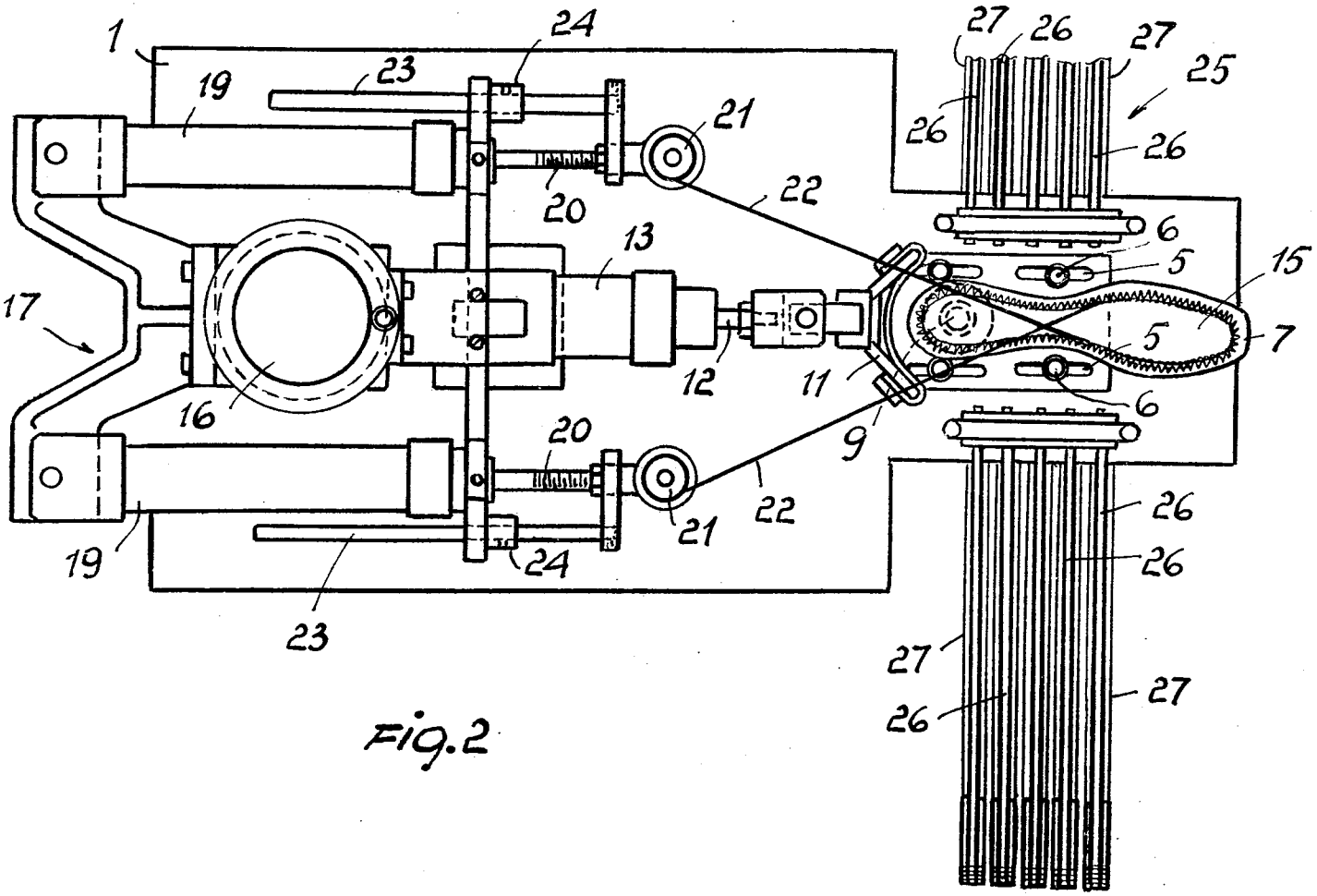
FIG. 2 is a plan view of the machine illustrated in FIG. 1.

It is evident from FIG. 1 that a column 16 on which is inserted a mobile unit 17 vertically slidable along the column 16 through the action of a handwheel 18, is also engaged to the frame 1. The unit 17 consists of a pair of third cylinders 19 parallel to each other and arranged on the sides of the second cylinder 13. The third cylinders 19 pneumatically control the movements of two partially threaded rods on which are engaged grasping members 21 each of which is structured in such a manner as to engage an end of the string 22 projecting from the uppers 7, predisposed for string assembly known as "Ficelle" or "string lasting." It is particularly visible in FIG. 1 that the grasping members 21 comprise, for each third cylinder 19, a cap 21*a* vertically and coaxially movable with respect to a fourth cylinder 21*b* also actuated pneumatically. The caps 21*a* can be lowered until they press and hold the ends of the string 22 embracing the upper. FIG. 2 shows guides 23 having the function of ensuring a precise movement of the rods 20, and also of limiting the stroke of the rods 20 themselves and therefore of the grasping members 21, by means of stopping blocks 24.

Figure 3:
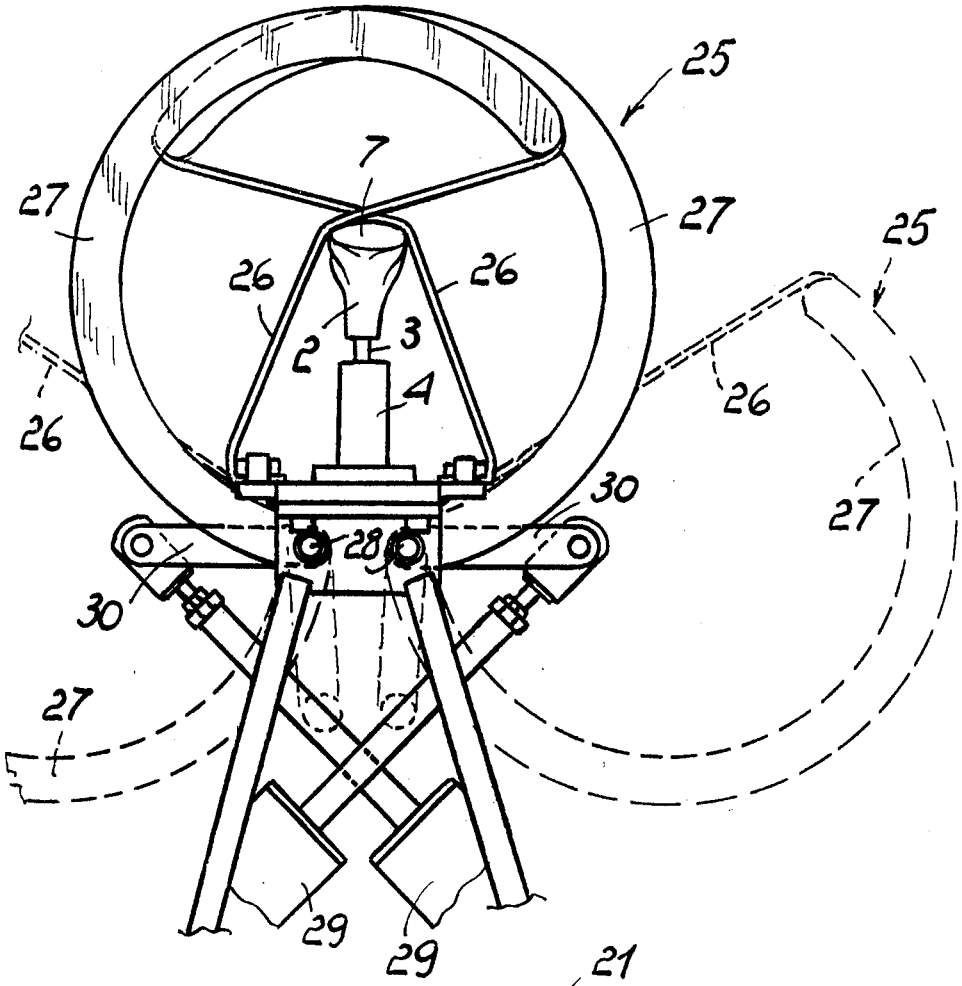
FIG. 3 puts in evidence a part of the machine with the mobile elements in two positions as seen from the front.
Figure 4:
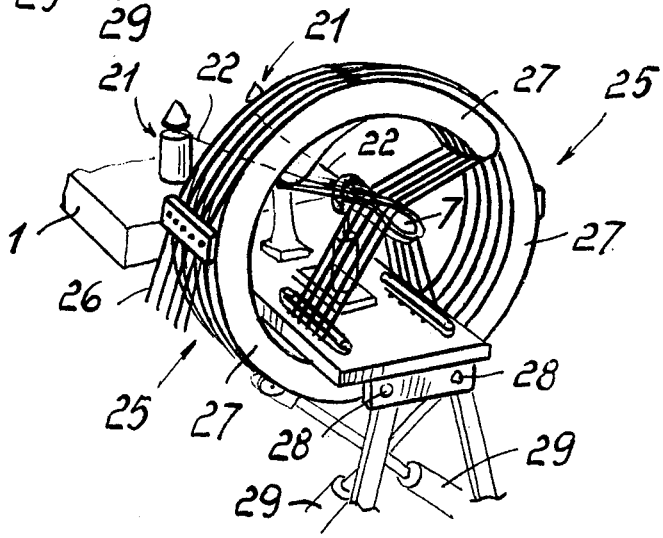
FIG. 4 is a schematic and perspective view of the same elements in closed position.

With reference in particular to FIGS. 2 and 3, according to the invention, elements for pressing the shanks of the upper 7 so as to make them adhere to the insole 15 covered with glue, are also provided. Said elements consist of clamps 25 arranged on the sides of the form 2 and movable in such a way as to press and pull the shanks of the upper 7 by means of elastic elements consisting of elastic bands 26. In greater detail, each clamp 25 consists of a plurality of arms 27 side by side and spaced apart in comb configuration, and shaped like an arc of a circumference extending in a vertical plane. These arms 26 are ridiidly engaged with a first lower extremity of pins 28 substantially parallel to the form 2 and engaged to the support frame 1. The arms 27 are pneumatically controlled by means of fifth cylinders 29 which act upon rods 30, one for each pin 28, fixed to the pins 28. The arms 27 of a clamp 25 are arranged alternately with respect to the arms 27 of the opposite clamp 25, so that when the clamp is in a closed position, as illustrated in FIGS. 3 and 4, the arms 27 intersect without interfering. The elastic bands 26 are taut and held on one side close to the base of the form 2, and on the other side in correspondance to the second upper extremity of the arms 27. In this embodiment, the elastic bands are also arranged on the external face of the arms 27 on which their ends are fixed. The arms 27 and the points to which are fixed the elastic bands 26, close to the base of the form 2, are arranged in such a way that, when the clamps 25 are in a closed position, the second extremities of the arms 27 position themselves past the point of alignment with the form 2 and the point to which are fixed the bands 26 close to the base of the form or last 2. The bands 26 bend about the point of contact with the upper 7 when the clamps 25 are in a closed position.

The operation of the invention is the following.

Firstly an operator positions the insole 15 on the form 2, placing the side covered with glue facing upwards, in correspondance to the section occupied by the bending of the upper and the sole. In order to avoid accidental movements of the insole 15, it may be manually stapled, e.g. with a stapler, to the form 2. Thereafter the operator places the upper 7 on the form 2 in the right position and, by depressing a pedal, controls the action of the first cylinder 8 and of the second cylinder 13 which bring respectively the appendix 9 and the buffer 11 in contact with the form 2 thus blocking the upper in the desired position and avoiding displacements of the form or last 2 inserted on the rod 3. Simultaneously the third cylinders 19 push the grasping members 21 forward towards the form 2 to prepare them for the subsequent operations. Then the operator fixes the two ends of the string 22 projecting from the upper 7 to the grasping members 21. That is the operator winds the ends of the string 22 under the caps 21*a* and then, by means of a plunger, causes, through the action of the fourth cylinders 21*b*, the lowering of the caps 21*a* which thereby press and block the string 22. At this point, through the control of the operator, the third cylinders 19 come into action by causing the grasping members 21 move backwards, therefore pulling the string 22 and making the upper 7 adhere to the form 2 and to the insole 15. The string 22 is pulled by its ends up to a predetermined point fixed by positioning the block 24 which limits the backward motion of the guides 23. The third cylinders 19 act independently, even though, for example they are actuated by the same source of compressed air: each end of the string 22 will be pulled proportionally to its resistance and independently from the position assumed by the other end. In this manner the operations involved in pulling the string 22 carried out by a skilled person, who grasps the ends of the string 22 with each hand, are reproduced. Experience teaches that this manner of forcing the upper 7 to adhere to the form 2 is far better than that accomplished by pulling simultaneously the ends of the string 22 engaged to an only grasping member. Once the string 22 has been pulled to the desired point, the operator releases the ends of the string 22 from the grasping members 21 by having the caps 21*a* lifted. Therefore the excess string 22, projecting from the upper 7, may be cut. Up to this step of formation of the upper, one obtains an upper 7 which adheres perfectly to the form 2 in the tip and heel sections, but which remains raised and unattached from the form, and therefore from the insole placed on the form, in its narrowest section of the shanks. In order to have this section also adhere to the glue covering the insole, or even if the glue is applied at the same moment with a separate device, the operator controls the backward movement of the appendix 9 and the rotation of the clamps 25. The clamps 25 close as shown in FIGS. 3 and 4 and by means of the elastic bands 26 press the shanks of the uppers 7 to make them adhere to the form 2. The adhesion is particularly effective in that the elastic bands 26, in addition to the actual pressing movement of the upper onto the form, are also provided with a sliding movement which stretches the upper and avoids the formation of creases. This sliding movement derives from the fact that, from the moment in which the clamps 25 are in the position of maximum closure, the bands 26 are gradually tensioned and lengthened and are therefore obliged to slide on the upper 7. This occurrence is quite visible in FIG. 3 in which it is to be considered that the length of the bands 26, in the absence of the form 2, would be remarkably smaller. The clamps 25 remain in the closed position indicated in FIGS. 3 and 4 until the shanks of the upper 7 adhere to the glue of the insole 15. If the glue is of normal type, i.e. not particularly fast-acting, it may be convenient, in order not to slow down the production rate, to introduce, after opening the clamps 25, a preliminary clamping operation of the shanks of the uppers to the insole, so as to avoid premature release. This operation may be carried out for example with a stapler.

The invention attains the proposed objects. In fact it is capable of providing a complete assembly of an upper on any form, which has not been previously prepared. The assembly is complete and precise in all its steps, both due to the differentiated pulling action on the two ends of the string projecting from the upper, and the stretching action applied on the shanks of the upper to have them adhere to the form without forming creases or curls of any sort. The machine according to the invention furthermore has a simple and functional structure, as well as being easily operated even by unskilled personnel. Therefore, thanks also to the high production level due to the continuity and functionality of the machine operations, a remarkable economical saving, capable of reducing the cost of the shoes, is guaranteed. The uppers produced with the above described machine may be indifferently associated to a sole by glueing, or inserted, while still on the assembly forms, into moulds wherein they are directly attached to soles obtained by injection moulding, or removed from the assembly forms and fitted over the metallic forms of the moulds.

The invention thus conceived is susceptible to numerous modifications all falling within the scope of the inventive idea.

Furthermore all the details may be substituted by technically equivalent elements.

In practice the materials employed and the dimensions may be selected as required.

I claim:

1. Machine for assembling uppers directly on assembly forms, comprising: means for removably blocking at least a form against translation and rotation, means for holding an upper and an insole externally covered with glue on said form, said upper being predisposed for string lasting assemblage with a string projecting therefrom, grasping members for removably engaging the string projecting from said upper and controllably movable in a direction appropriate for pulling said string in order to have the tip and the heel of said upper adhere to the glue of said insole placed on the form, and elements for pressing the shanks of the upper so as to cause them to adhere to said insole, wherein said means for holding an upper and an insole on said form consists of adjustable and pneumatically movable blocking elements.

2. Machine according to claim 1, wherein said assembly form comprises means for preventing rotation thereof consisting of a substantially vertical grooved rod insertable in a hole matching thereto, made in the form itself.

* * * * *